US010858798B2

(12) United States Patent
Lee et al.

(10) Patent No.: US 10,858,798 B2
(45) Date of Patent: Dec. 8, 2020

(54) STEEL PIPE COFFERDAM CONSTRUCTION METHOD USING SUCTION PENETRATION AND STACKING OF PIPE MEMBERS

(71) Applicant: KOREA INSTITUTE OF CIVIL ENGINEERING AND BUILDING TECHNOLOGY, Goyang-si (KR)

(72) Inventors: Ju-Hyung Lee, Paju-si (KR); Jae-Hyun Kim, Daejeon (KR); Hak-Man Kim, Jeonju-si (KR)

(73) Assignee: KOREA INSTITUTE OF CIVIL ENGINEERING AND BUILDING TECHNOLOGY, Goyang-si (KR)

( * ) Notice: Subject to any disclaimer, the term of this patent is extended or adjusted under 35 U.S.C. 154(b) by 0 days.

(21) Appl. No.: 16/699,523

(22) Filed: Nov. 29, 2019

(65) Prior Publication Data

US 2020/0173132 A1 Jun. 4, 2020

(30) Foreign Application Priority Data

Dec. 4, 2018 (KR) ..... 10-2018-0154244

(51) Int. Cl.
*E02D 19/04* (2006.01)
*E02D 15/08* (2006.01)

(52) U.S. Cl.
CPC ..... *E02D 19/04* (2013.01); *E02D 15/08* (2013.01); *E02D 2200/1685* (2013.01); *E02D 2220/00* (2013.01); *E02D 2250/0053* (2013.01); *E02D 2250/0061* (2013.01); *E02D 2600/20* (2013.01)

(58) Field of Classification Search
CPC ..... E02D 19/02; E02D 19/04
USPC ..... 405/13, 14
See application file for complete search history.

(56) References Cited

U.S. PATENT DOCUMENTS 675,125 A * 5/1901 Brown ..... E02D 19/04 405/13
782,383 A * 2/1905 Doty ..... E02D 19/04 405/14
782,410 A * 2/1905 Moran et al. ..... E02D 23/02 405/8
3,380,256 A * 4/1968 Rebikoff ..... E21B 15/02 405/13
3,686,877 A * 8/1972 Bodin ..... E02D 7/18 405/8
4,527,926 A * 7/1985 Hyttinen ..... E02D 19/04 405/14
4,963,058 A * 10/1990 Broughton ..... E02B 17/0017 405/207
6,923,600 B1 * 8/2005 Bae ..... E01D 22/00 249/209

(Continued)

FOREIGN PATENT DOCUMENTS

JP 01043621 A * 2/1989
JP 01052921 A * 3/1989

(Continued)

*Primary Examiner* — Frederick L Lagman
(74) *Attorney, Agent, or Firm* — Goldilocks Zone IP Law

(57) ABSTRACT

A circular pipe member is penetrated into the seabed by a suction pressure, and a plurality of circular pipe members are vertically stacked thereon and integrated thereto to construct a cofferdam. When dismantling the cofferdam, the circular pipe members are disassembled and dismantled in order by using a lifting wire installed at a newly constructed structure installed in the inner space of the cofferdam.

3 Claims, 13 Drawing Sheets

(56) References Cited

U.S. PATENT DOCUMENTS

| | | | | |
|---|---|---|---|---|
| 9,797,110 | B1 * | 10/2017 | Milani-nia | E02D 19/04 |
| 2005/0175416 | A1 * | 8/2005 | Bae | E01D 22/00 405/231 |
| 2015/0197911 | A1 * | 7/2015 | Burkhardt | E02D 19/04 405/14 |

FOREIGN PATENT DOCUMENTS

| | | | |
|---|---|---|---|
| KR | 10-0652454 | B1 | 12/2006 |
| KR | 10-0923078 | B1 | 11/2009 |
| KR | 10-2013-0013287 | A | 2/2013 |
| KR | 10-1443598 | B1 | 9/2014 |
| KR | 10-1806851 | B1 | 12/2017 |
| KR | 10-1895259 | B1 | 10/2018 |

* cited by examiner

STEEL PIPE COFFERDAM CONSTRUCTION METHOD USING SUCTION PENETRATION AND STACKING OF PIPE MEMBERS

CROSS-REFERENCE TO RELATED APPLICATION

This application claims priority to Korean Patent Application No. 10-2018-0154244, filed on Dec. 4, 2018, and all the benefits accruing therefrom under 35 U.S.C. § 119, the contents of which in its entirety are herein incorporated by reference.

BACKGROUND

1. Field

The present disclosure relates to a cofferdam construction method, which includes a process of installing a cofferdam in water to secure a dry working space and a process of removing the cofferdam after the work in the cofferdam is completed.

DESCRIPTION ABOUT NATIONAL RESEARCH AND DEVELOPMENT SUPPORT

The present invention was the results of the study supported by the Ministry of Land, Infrastructure and Transport, Republic of Korea (Project No. 18SCIP-B119960-03) under the superintendence of Korea Agency for Infrastructure Technology Advancement.

2. Description of the Related Art

A cofferdam is constructed in water such as rivers and seas to secure a dry working space therein. For example, when constructing a bridge foundation and a bridge structure, the cofferdam is installed, and the water in the cofferdam is drained to form a dry working space. After that, if the bridge foundation and the bridge structure are completely constructed in the dry working space, the cofferdam will be removed. In the prior art, a large steel pipe is used as the cofferdam. A large-diameter steel pipe having a vertical length longer than the water depth and open at both ends thereof is transported on the sea. By using a large floating crane, the large steel pipe is lifted and put into water, and then is submerged by the weight of the steel pipe. If the region between the large steel pipe and the seabed is watertight, the water in the large steel pipe is drained to form a dry working space. Necessary works for constructing a bridge structure or the like are carried out inside the cofferdam, and if the works are completed, the large steel pipe is lifted again using the floating crane and transported to the land.

However, if the large steel pipe is simply submerged with self-weight thereof, it may be difficult to make the region between the steel pipe and the seabed surface into a watertight state. In order to make watertight between the large steel pipe and the seabed surface, it may be necessary to insert a lower end of the steel pipe deep into the seabed. For example, a thick weak ground layer may exist at the surface layer of the seabed. In this situation, even if the lower end of the steel pipe is penetrated deeply into the weak ground layer, the vertical length of the steel pipe will increase significantly such that the upper end of the steel pipe is located above the surface of the water. If the vertical length of the steel pipe increases, the size and weight of the steel pipe increase as much, which makes it difficult to transport and handle the steel pipe. In order to put a large steel pipe with great size and weight into water, a floating crane with a very large capacity is required. The large-capacity floating crane must also be used to remove the cofferdam. Procuring and operating the large-capacity floating crane needs enormous expense and also highly depends on weather conditions. Thus, when constructing a cofferdam using a large steel pipe according to the prior art, there may be great difficulty and disruption in procuring and operating a large-capacity floating crane, which may delay the construction or demand a large construction cost.

DETAILED DESCRIPTION

In the specification and claims, the term "circular pipe member" should be understood to include pipes with not only a circular cross-sectional shape but also an elliptical or other polygonal shape. A cofferdam may be installed not only in the sea but also in rivers. Thus, in the specification and claims, the term "seabed" should be understood to mean not only underwater grounds in the sea but also bottoms in the rivers.

A main circular pipe member is submerged by its own weight. Subsequently, additional circular pipe members having a vertical height easily handled and transported are stacked on the main circular pipe member in the vertical direction as many as necessary, and upper and lower circular pipe members are water-tightly assembled to form a cofferdam 100. If the cofferdam is constructed in this way, even when the main circular pipe member is deeply penetrated into the seabed, the vertical length of the main circular pipe member may be prevented from being excessively increased. Thus, even though the cofferdam is installed at a deep depth or the cofferdam has a large cross-sectional size, it is possible to exclude the use of a large-capacity crane, so that the cofferdam may be efficiently and economically constructed.

If a weak ground of a significant depth is present at the surface layer of the seabed 300, even if a main circular pipe member 1 is placed on the seabed 300 by its own weight, the region between the main circular pipe member 1 and the seabed 300 is not completely watertight. This is because a lower end of main circular pipe member 1 may not be sufficiently penetrated into the seabed 300 just by simply submerging the main circular pipe member 1 by its own weight. If the lower end of the main circular pipe member 1 is not sufficiently penetrated into the seabed 300, the main circular pipe member 1 may not support the additional circular pipe member. In this case, the lower end of the main circular pipe member 1 is penetrated into the seabed by means of a suction pressure. Before or while stacking the additional circular pipe member onto the main circular pipe member, if necessary, the main circular pipe member is penetrated into the seabed to a depth capable of ensuring watertight property by a suction pressure. In this way, the region between the lower end of the main circular pipe member and the seabed may be securely watertight, and sufficient supporting force may be ensured.

Figure 1:
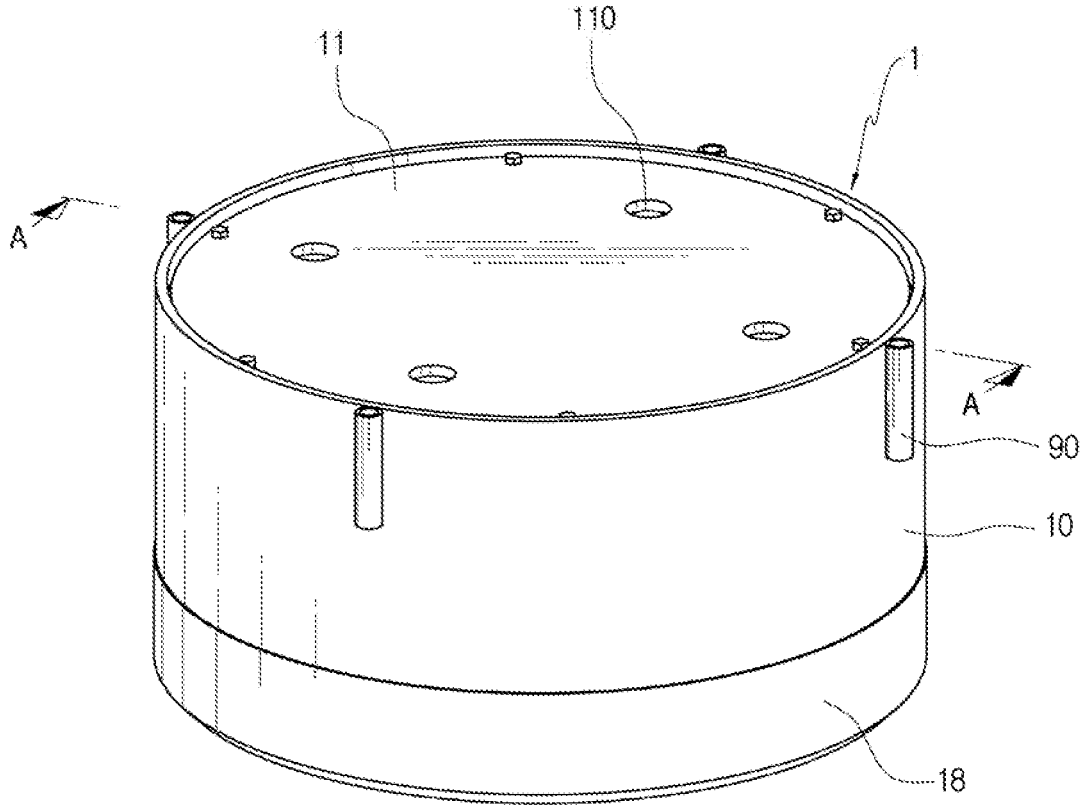
FIG. 1 is a perspective view showing an example of a main circular pipe member (a main pipe).
Figure 2:
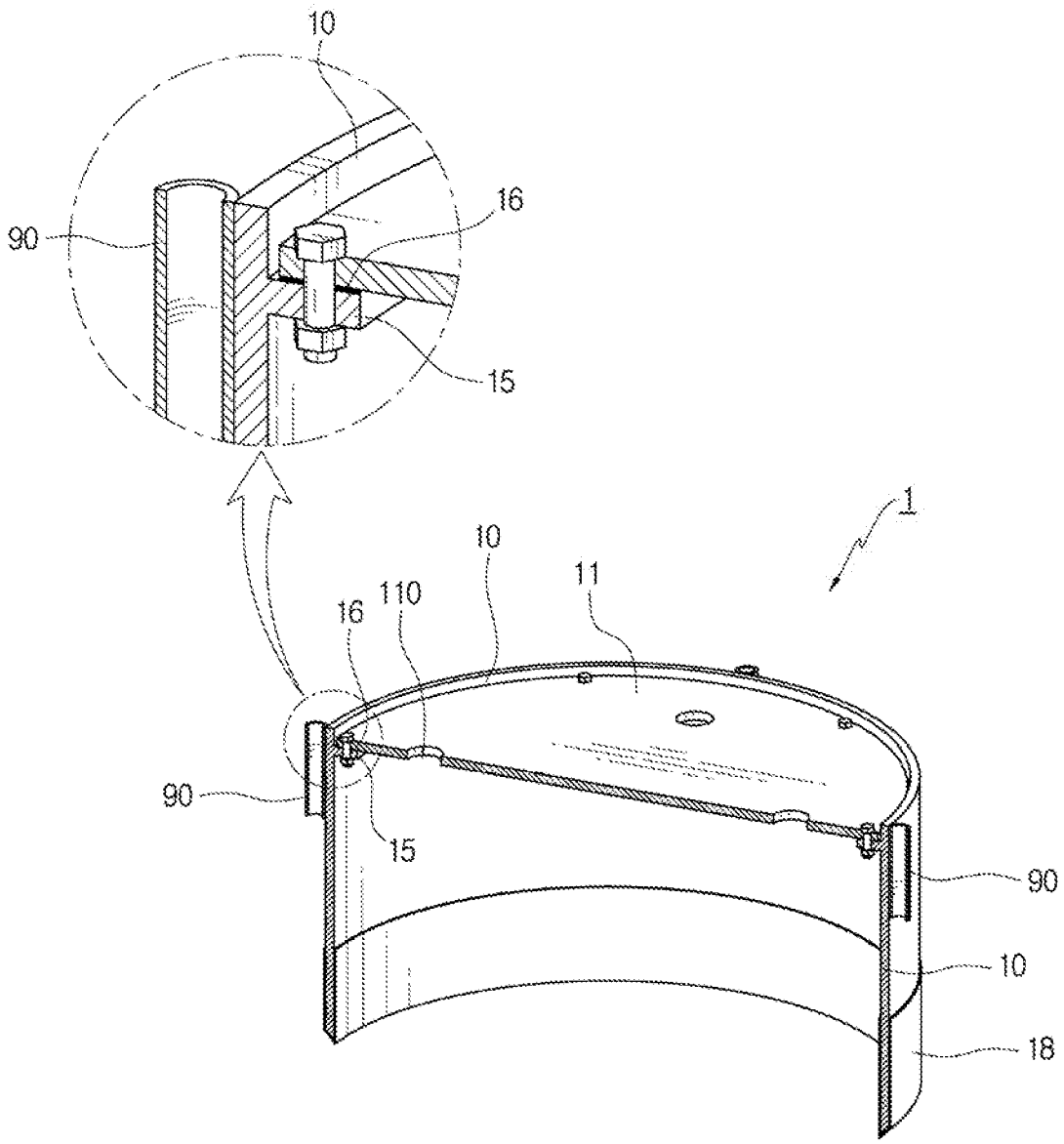
FIG. 2 is a half-sectioned perspective view, taken along the line A-A of FIG. 1.

As shown in FIGS. 1 and 2, the main circular pipe member 1 is made of a steel pipe body 10. The main circular pipe member 1 is located at a lowermost end of a cofferdam 100. A pile coupling member 90 is integrally provided to an outer edge of the steel pipe body 10 by welding or the like. The pile coupling member 90 is made of a pipe member through which a guide pin pile 9 may penetrate. The edge of the lowermost end of the main circular pipe member 1 is preferably covered by a coating member 18.

In FIGS. 1 and 2, a cover 11 is assembled to block a traverse section of the steel pipe body 10. A lower side of the steel pipe body 10 is open. Thus, an inner hollow is formed by the steel pipe body 10 and the cover 11. A suction hole 110 is formed in the cover 11 for suction. After the main circular pipe member 1 is penetrated into the seabed 300 to a required depth by suction, the cover 11 is removed. Thus, the cover 11 is assembled to the steel pipe body 10 so as to be capable of being disassembled. In the embodiment depicted in FIGS. 1 and 2, a horizontal coupling flange 15 is installed at an inner surface of the steel pipe body 10 at a location spaced downward by a predetermined distance from the uppermost surface of the main circular pipe member 1. In a state where an edge of the cover 11 is positioned on the coupling flange 15, the coupling flange 15 and the cover 11 are bolted together. A sealing material 16 may be disposed between the coupling flange 15 and the cover 11.

The work for penetrating the main circular pipe member into the seabed by the suction pressure to a depth capable of securing watertight property (the suction installation work) may be performed before the additional circular pipe member is stacked on the main circular pipe member, while the additional circular pipe member is being stacked, or after a required number of additional circular pipe members are entirely stacked and integrated with each other. Thus, the location where the cover 11 is assembled and installed is not necessarily limited to the main circular pipe member 1 as exemplarily shown in FIGS. 1 and 2. The cover 11 may be installed at an inner or upper end of the additional circular pipe member, instead of the main circular pipe member 1.

Figure 3:
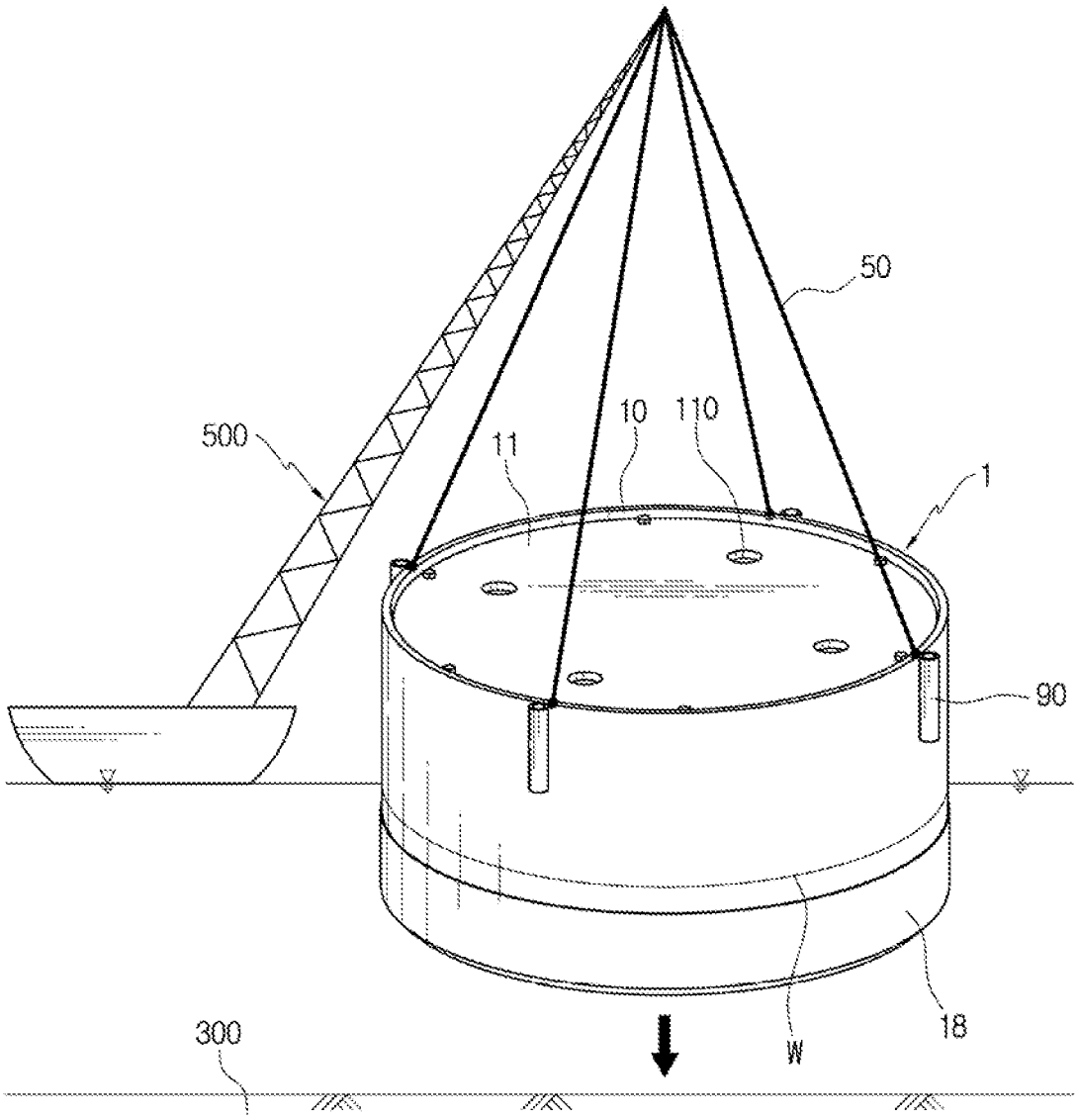
FIGS. 3 to 7 are schematic diagrams for showing a process of constructing a cofferdam according to the present disclosure in order.

The line marked with an alphabet W in the figure indicates a location of the water surface. The line marked with an alphabet S indicates a location of the upper surface of the seabed 300. In order to install the cofferdam, the main circular pipe member 1 to be located at the lowermost end is firstly transported to a site using a carrier such as a floating barge. As shown in FIG. 3, the main circular pipe member 1 transported to the site is lifted using a floating crane 500 and a crane wire 50 and then submerged by its own weight to be placed at a designed location on the seabed 300. The vertical length of main circular pipe member 1 is smaller than the total vertical height of the cofferdam 100. Thus, the floating crane 500 for lifting the main circular pipe member 1 may not employ a large-capacity floating crane required in the prior art.

Figure 4:
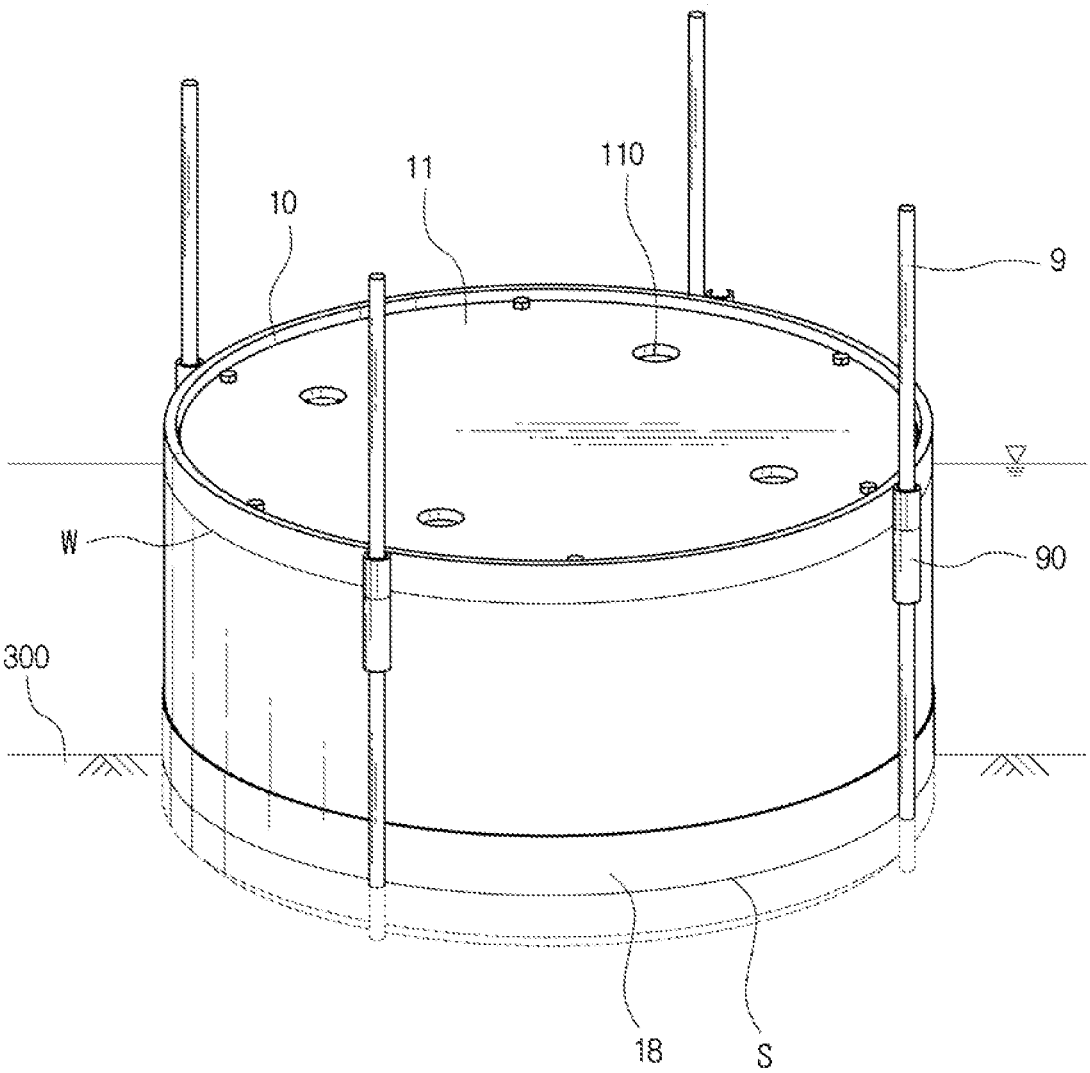

After the main circular pipe member 1 is placed at the designed location on the upper surface of the seabed 300, a plurality of vertical guide pin piles 9 are installed. The guide pin pile 9 is installed so that its lower end is penetrated into the seabed 300. As shown in FIG. 4, the guide pin pile 9 is inserted into the pile coupling member 90 of the main circular pipe member 1. The guide pin pile 9 guides the circular pipe members to vertically move down accurately to a predetermined position, when the main circular pipe member 1 is penetrated into the seabed by the suction pressure and when the additional circular pipe member moves down to be stacked on the main circular pipe member 1. In addition, the guide pin pile 9 guides the additional circular pipe member to vertically move down safely and stably even against waves or the like. Since the guide pin pile 9 is provided, the additional circular pipe member is stacked with precise verticality. The guide pin pile 9 may be installed in plural.

Figure 5:
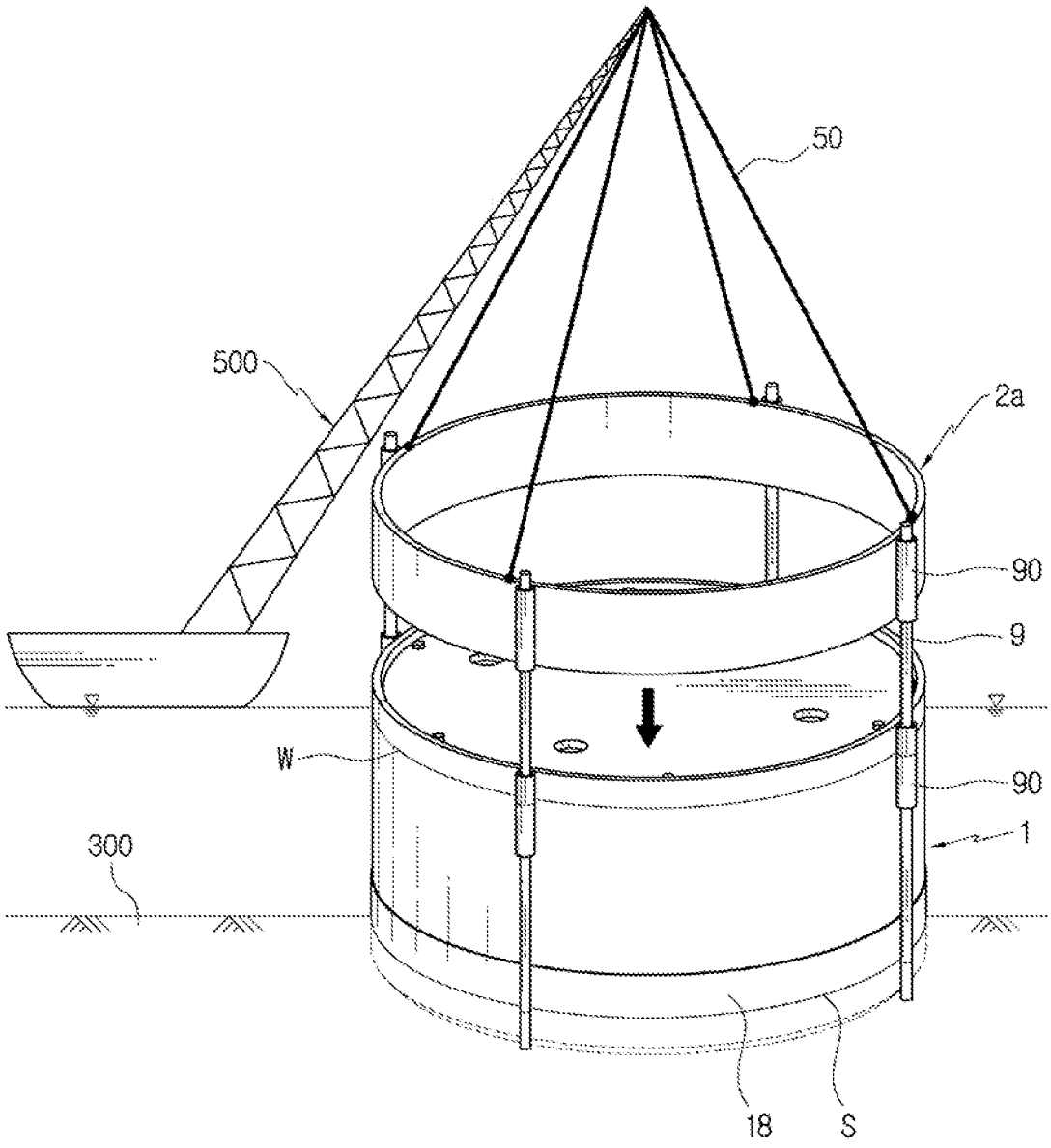
Figure 6:
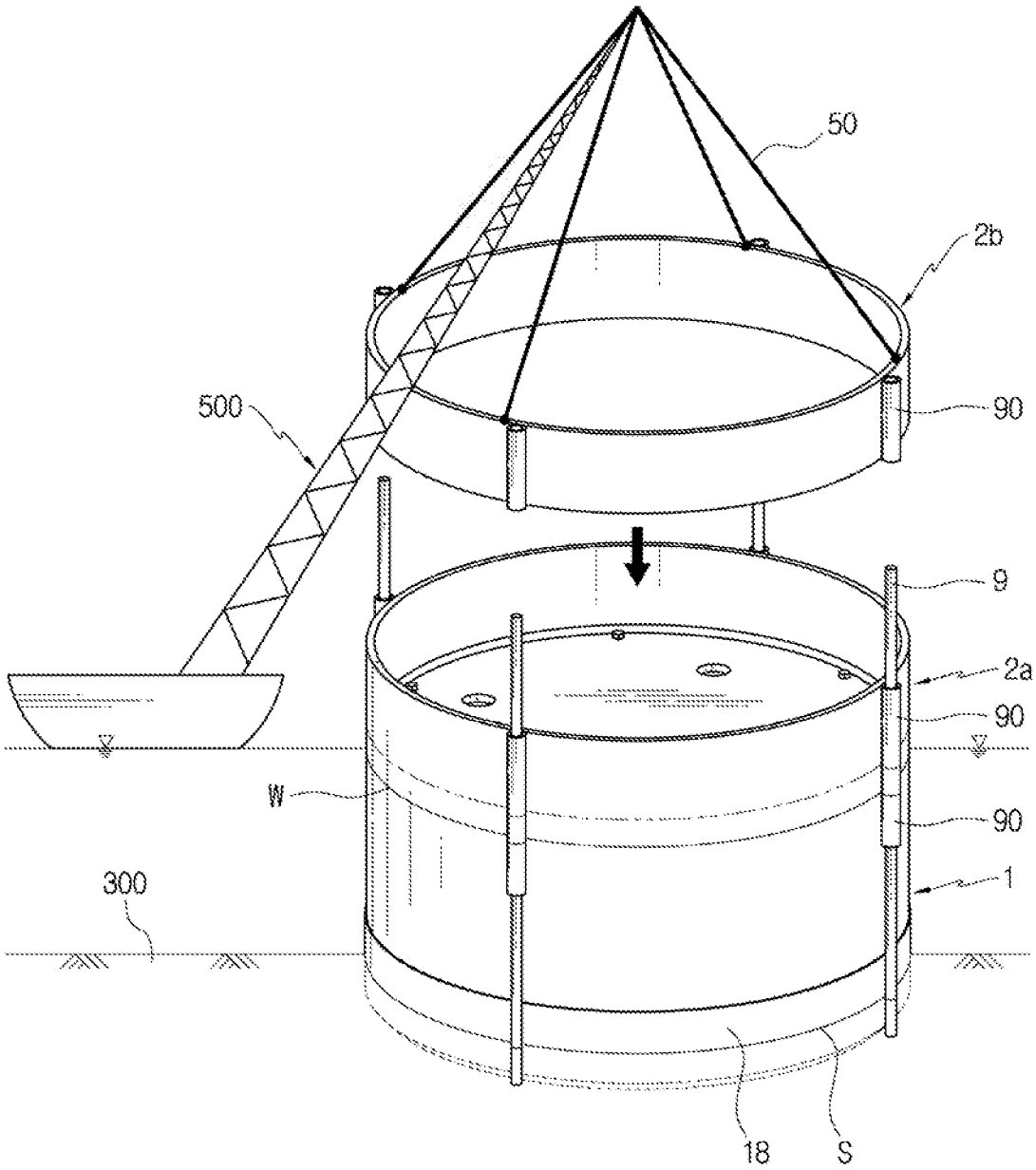

In a state where the main circular pipe member 1 is submerged by its own weight to be placed on the seabed 300 and the upper end of the main circular pipe member 1 is located above the water surface, the additional circular pipe member is further stacked on the main circular pipe member 1. The additional circular pipe member is transported to the site using a carrier. As shown in FIG. 5, the additional circular pipe member is lifted with a floating crane and placed on the main circular pipe member 1 to be stacked thereon. Subsequently, the main circular pipe member 1 and the additional circular pipe member are assembled together in a watertight form so as to be capable of being disassembled later, by working above the water surface. In particular, as shown in FIG. 6, if necessary, a plurality of additional circular pipe members are vertically stacked according to the water level of the site where the cofferdam is to be installed, and then assembled together in a watertight form so as to be capable of being disassembled later. In the figures, it is illustrated that two additional circular pipe members are installed. Among the two additional circular pipe members shown in the figures, for convenience, the additional circular pipe member located below is referred to as a "first-level additional circular pipe member 2*a*", and the additional circular pipe member located above is referred to as a "second-level additional circular pipe member 2*b*".

The additional circular pipe member has the same diameter and cross-sectional shape as the main circular pipe member 1. Like the main circular pipe member 1, a pile coupling member 90 may be provided to an outer surface of the additional circular pipe member. In this case, the additional circular pipe member may move down to be stacked on the main circular pipe member 1 in a state where the guide pin pile 9 is inserted into the pile coupling member 90. Thus, the additional circular pipe member may be stably moved down accurately in a vertical state at a predetermined location. In the figures, a dashed line with two dots indicates a joined portion between the circular pipe members.

In a state where the main circular pipe member 1 is submerged by its own weight and its upper end is positioned above the water surface, the first-level additional circular pipe member 2*a* is placed thereon and stacked vertically. The joined portion between the main circular pipe member 1 and the first-level additional circular pipe member 2*a* is present above the water surface. Thus, the work for assembling the circular pipe members 1, 2*a* may be performed above the water surface as a whole, rather than under the water. In the case of further stacking and integrating the second-level additional circular pipe member 2*b* on the first-level additional circular pipe member 2*a*, the joined portion between the additional circular pipe members 2*a*, 2*b* is also present above the water surface. Thus, the work for assembling the additional circular pipe members may also be efficiently performed above the water surface as a whole.

Coupling flanges may be formed at upper and lower ends of the circular pipe member, respectively, and the coupling flanges may be bolted in a state where the coupling flanges face each other by stacking the circular pipe members. In this way, the regions between the main circular pipe member 1 and the additional circular pipe member thereabove and between the plurality of additional circular pipe members stacked thereon may be assembled and coupled in a watertight form so as to be capable of being disassembled later.

If the circular pipe member has a greater diameter, the cover 11 may sag down when the suction installation work is performed. As a countermeasure, an auxiliary pile may be further installed, if necessary. A perforation hole is formed at the center of the cover 11, and the auxiliary pile is inserted into the perforation hole so that a lower end of the auxiliary pile is penetrated into the seabed. The auxiliary pile is integrated with the cover 11. According to this configuration, the auxiliary pile supports the cover 11.

Figure 7:
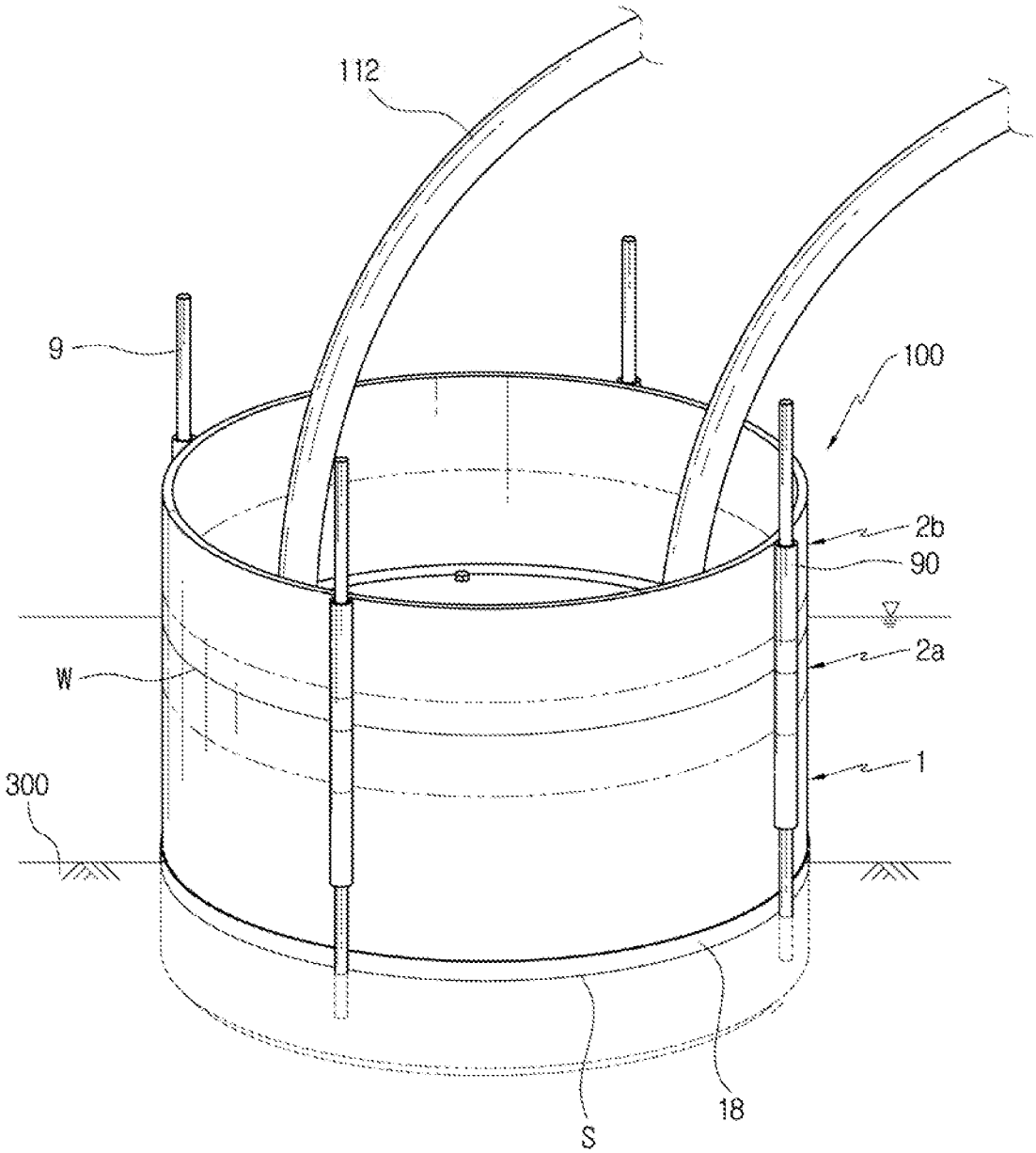

After the additional circular pipe member is completely stacked on the main circular pipe member 1, the main circular pipe member may be penetrated into the seabed to a depth capable of securing watertight property by the suction pressure. For this purpose, as shown in FIG. 7, a suction hose 112 is connected to the suction hole 110 formed in the cover 11 of the main circular pipe member 1, and the inner hollow existing under the cover 11 is sucked. By the suction, the inner hollow under the cover 11 comes into a negative pressure state to generate a downward suction pressure. The suction pressure is applied downward to the main circular pipe member 1, and the lower end of the main circular pipe member 1 is penetrated into the seabed 300 (the suction installation work). The suction installation work may be performed before the additional circular pipe members are entirely stacked. If necessary, the suction installation work may be performed to penetrate the main circular pipe member 1 into the seabed 300, and also the additional circular pipe members may be stacked on the main circular pipe member 1 in sequence to meet the speed at which the main circular pipe member 1 moves down.

The location where the upper and lower circular pipe members are assembled and connected may be at a constant height for the efficient joining of the upper and lower circular pipe members. To this end, it is preferable to sequentially stack a plurality of additional circular pipe members to meet the speed at which the main circular pipe member 1 is penetrated into the seabed 300. This process is performed in the following order:

(A) the first-level additional circular pipe member 2*a* is assembled and coupled on the main circular pipe member 1;

(B) the main circular pipe member 1 is sucked to penetrate its lower end into the seabed;

(C) the second-level additional circular pipe member 2*b* is disposed on the first-level additional circular pipe member 2*a* to be assembled and coupled above the water surface before the upper end of the first-level additional circular pipe member 2*a* is submerged below the water surface; and (D) the main circular pipe member 1 is sucked again to penetrate its lower end into the seabed.

Figure 8:
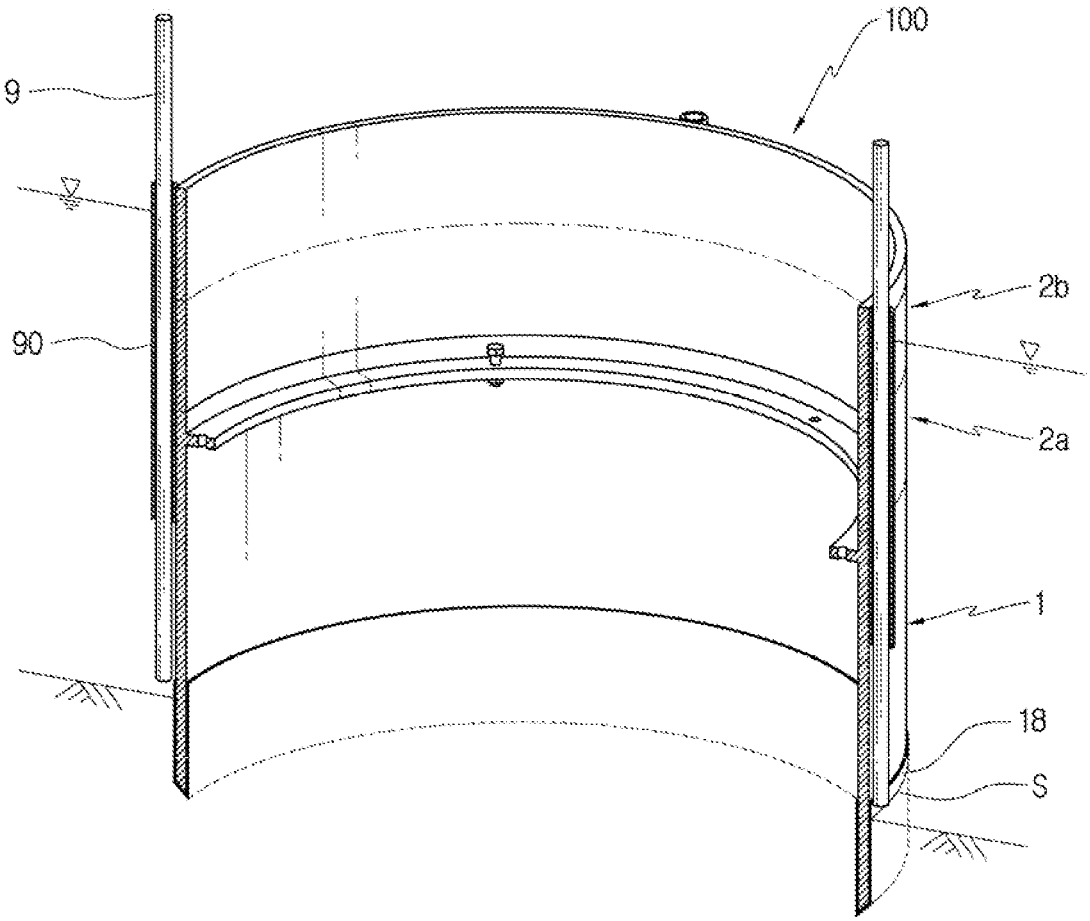
FIG. 8 is a sectioned perspective view showing that the cofferdam is completely constructed according to the present disclosure.

By the suction, the lower end of the main circular pipe member 1 is penetrated into the seabed 300 to a depth necessary for securing the watertight property and the support force, and a required number of additional circular pipe members are stacked and assembled thereon in a watertight form. Also, if the upper end of the additional circular pipe member located at the uppermost side is positioned above the water surface, the cover 11 is separated and removed. As a result, as shown in FIG. 8, the cofferdam 100 having a cylindrical inner space is completed.

Since the lower end of main circular pipe member 1 is penetrated into the seabed to a required depth by the suction pressure, it is possible to ensure a certain watertight property and a support force between the main circular pipe member 1 and the seabed 300. Thus, the cofferdam 100 may be installed quickly and easily. A single additional circular pipe member or a plurality of additional circular pipe members with a vertical height easily handled and transported are stacked vertically on the main circular pipe member 1 and assembled to each other in a watertight form to construct the cofferdam 100 whose upper end is present at a sufficient height above the water surface. Even though the water level is deep and the depth at which the lower end of the circular pipe member is penetrated into the seabed is large, the vertical length of the main circular pipe member 1 may not be excessively increased. Thus, it is possible to easily handle the circular pipe members while eliminating the use of a large-capacity floating crane, thereby exhibiting advantageous effects such as reduced construction cost and shortened construction period. Since the cofferdam 100 may be easily constructed according to the depth of the site, the cofferdam 100 shows the advantage of having excellent applicability in various sites with different depths.

Figure 9:
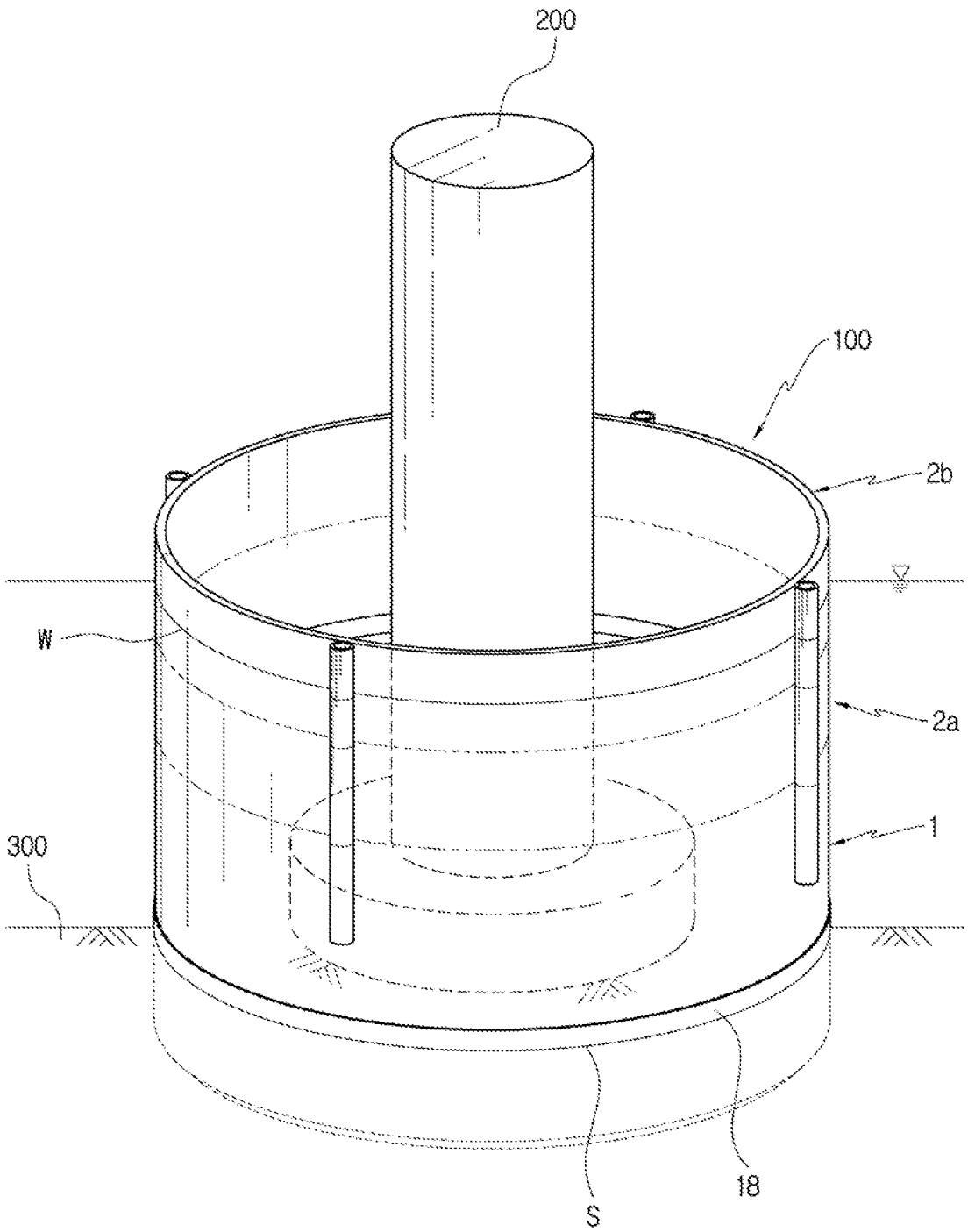
FIGS. 9 to 13 are perspective views for showing a process of dismantling and removing the cofferdam according to the present disclosure in order.
Figure 10:
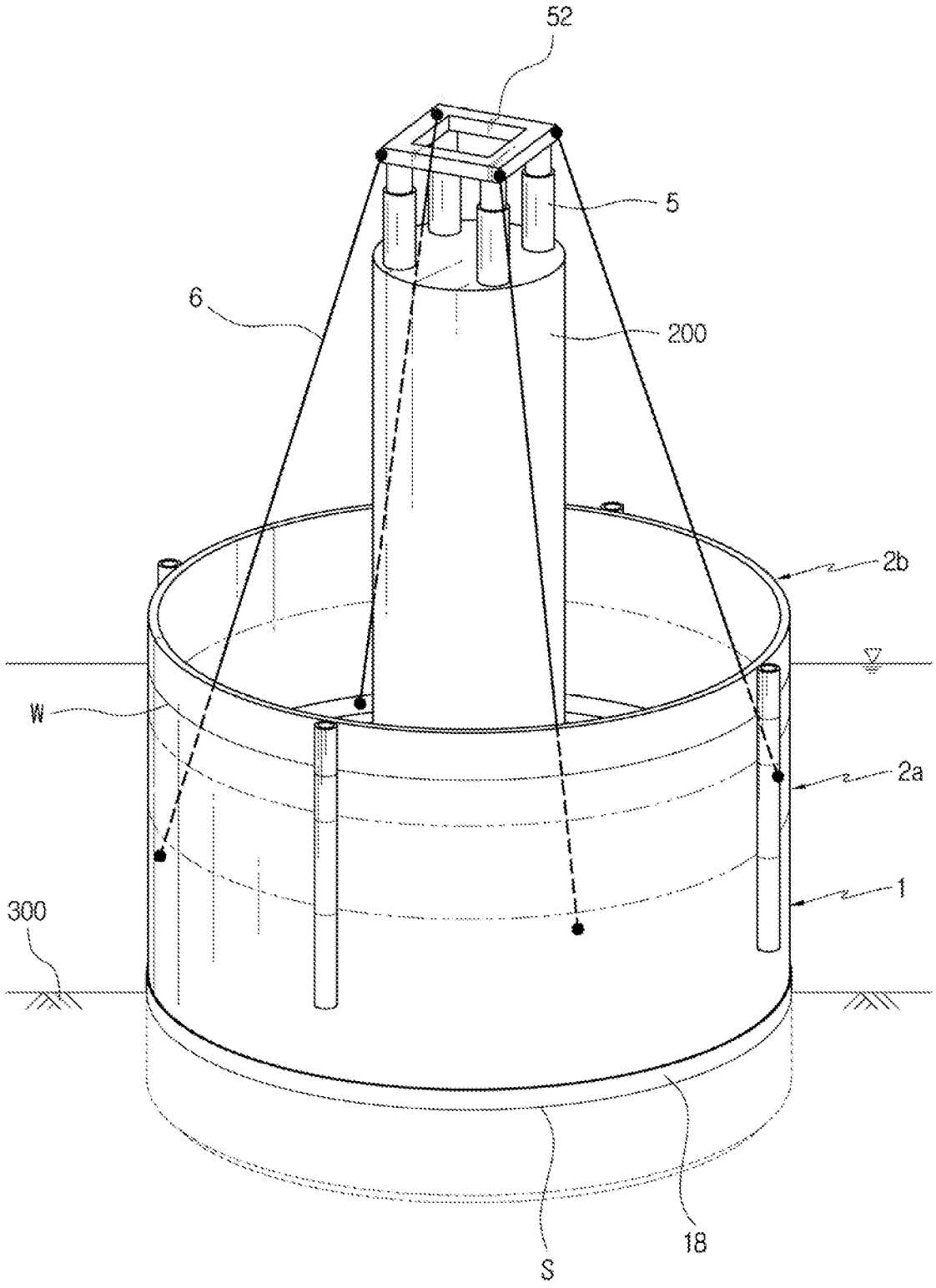

Next, the process of dismantling the cofferdam will be described with reference to FIGS. 9 to 13. If the cofferdam 100 is constructed, the water in its inner space is drained to secure a dry work space so that the necessary work is performed inside the dry working space. If the necessary work is done, the cofferdam 100 is dismantled. FIG. 9 shows that a bridge structure 200 is constructed in the inner space of the cofferdam 100. In order to dismantle the cofferdam 100, a wire lifting device is installed at an upper end of the bridge structure 200 to change the length of the lifting wire. The wire lifting device may be made of a "wire winding device" that is capable of winding or unwinding the lifting wire 6. The wire lifting device may also be made of an extendable jack device whose full length is capable of extending or contracting, like a hydraulic jack. The extendable jack device and the wire winding device may be used together as the wire lifting device. In FIG. 10, it is exemplarily shown that the extendable jack device 5 is installed as the wire lifting device. The extendable jack device 5 may be provided in plural. As shown in the figure, a plurality of extendable jack devices 5 may be connected using a frame member 52. In this case, the plurality of extendable jack devices may be extended and contracted at the same time.

Figure 11:
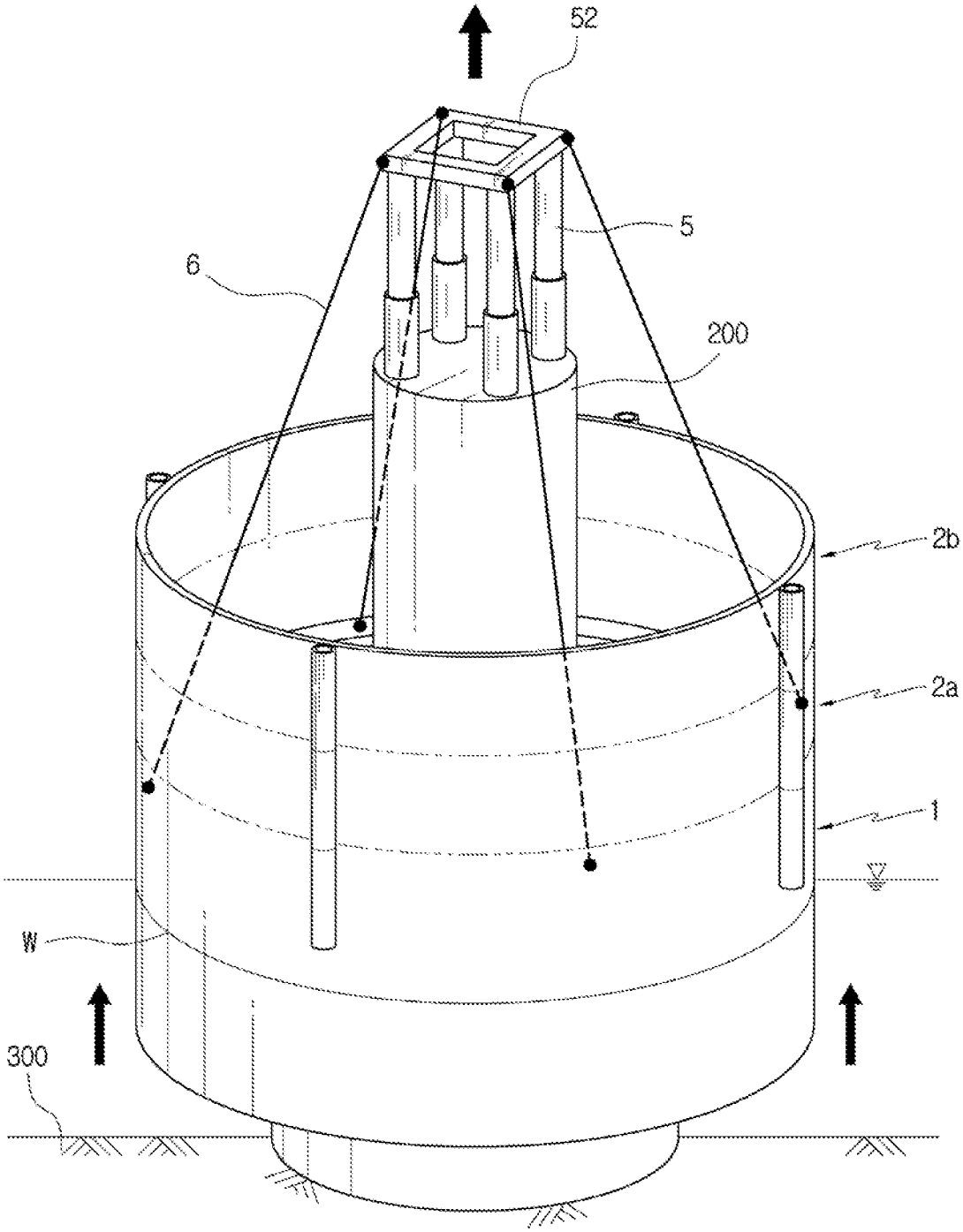

If the plurality of extendable jack devices 5 are installed, as shown in FIG. 10, the lifting wire 6 is connected and installed between each extendable jack device 5 and the main circular pipe member 1. One end of the lifting wire 6 is coupled to the extendable jack device 5, and the other end of the lifting wire 6 is coupled to the main circular pipe member 1. If the lifting wire 6 is pulled by extending the extendable jack device 5 as shown in FIG. 11, the main circular pipe member 1 is drawn from the seabed 300, and the entire cofferdam 100 moves upward. If the lowest end of the main circular pipe member 1 is covered with the coating member 18, when the lifting wire 6 is pulled, the lowest end of the main circular pipe member 1 is peeled off from the coating member 18 and is easily drawn from the seabed 300. In FIG. 11, the coating member 18 is not depicted.

If necessary, the lower end of the cofferdam 100 may be drawn to some extent or completely from the seabed 300 by increasing the pressure inside the cofferdam 100 before pulling the lifting wire 6. That is, the cover 11 is assembled again to the cofferdam 100 to seal the inner space of the cofferdam 100, and then an injection hose is connected to the cover 11 to inject water into the inner space of the cofferdam 100 through the injection hose so that the pressure in the inner space of the cofferdam 100 is increased. By doing so, the lower end of the cofferdam 100 is drawn from the seabed 300. If the upper end of the bridge structure 200 is located higher than the upper end of the cofferdam 100, an additional circular pipe member may be further installed at the upper end of the cofferdam 100 as described above, so that the upper end of the cofferdam 100 is located higher than the bridge structure 200, and then the cover 11 is assembled to the upper end thereof. Through this process, in a state where the lower end of the cofferdam 100 is pulled to some extent or entirely from the seabed 300, as shown in FIGS. 10 and 11, the extendable jack device 5 and the lifting wire 6 are installed to the bridge structure 200. In addition, the lifting wire 6 is pulled to move the main circular pipe member 1 upward. By this process, the speed and efficiency of the work of moving the cofferdam 100 upward may be improved. However, in the process of moving the cofferdam 100 upward, increasing the pressure in the inner space of the cofferdam may be optionally performed when required.

Figure 12:
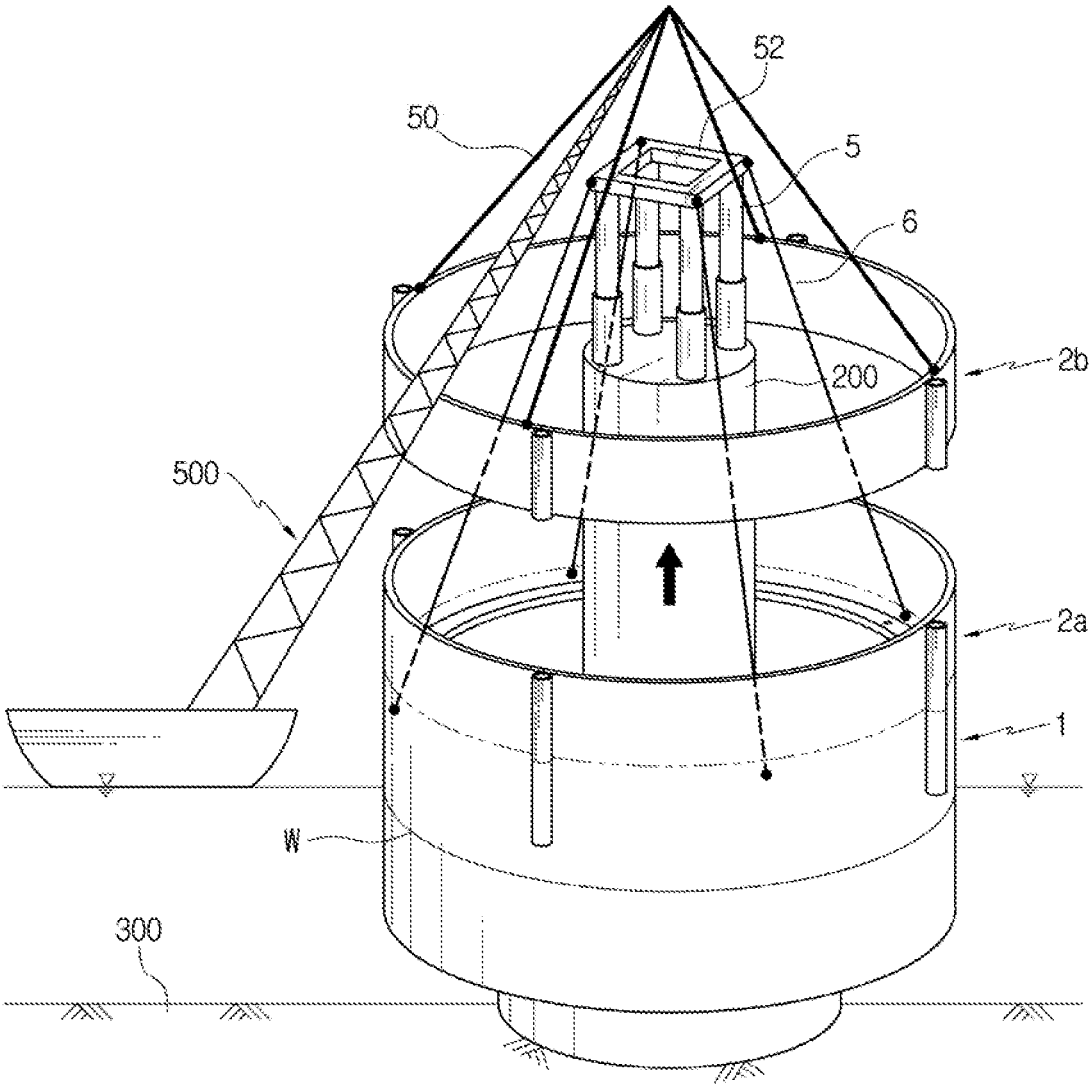

If the joined portion between the additional circular pipe members at the upper and lower layers is located above the water surface as the lifting wire 6 is pulled to move the main circular pipe member 1 upward, the main circular pipe member 1 stops moving upward temporarily. In this state, as shown in FIG. 12, the crane wire 50 connected to the floating crane 500 is connected to the second-level additional circular pipe member 2*b* located above the water surface. The second-level additional circular pipe member 2*b* is separated from the first-level additional circular pipe member 2*a* therebelow, and the second-level additional circular pipe member 2*b* is removed using the floating crane 500. If a plurality of additional circular pipe members are stacked when constructing the cofferdam 100, the following steps are repeated to separate and remove all additional circular pipe members in order:

(A) the crane wire 50 is connected to the additional circular pipe member located at the uppermost side;

(B) the additional circular pipe member located at the uppermost side is removed by separating and disassembling from the additional circular pipe member therebelow;

(C) the lifting wire 6 is pulled to move the cofferdam 100 upward;

(D) the crane wire 50 is connected to the additional circular pipe member that is newly located at an uppermost side;

(E) the additional circular pipe member connected to the crane wire 50 is removed by separating and disassembling from the additional circular pipe member therebelow; and (F) the lifting wire 6 is pulled to move the cofferdam 100 upward.

Figure 13:
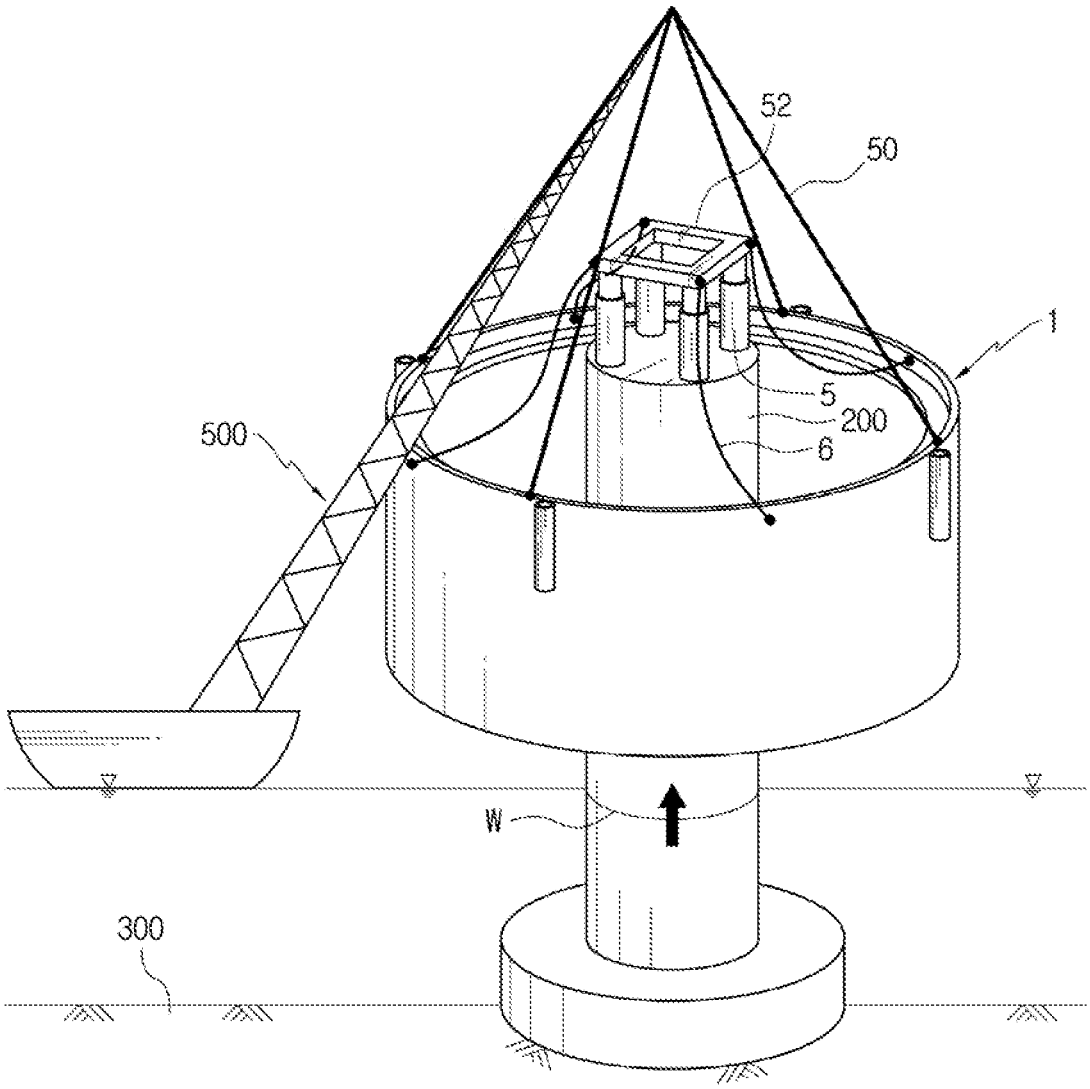

The work for removing the additional circular pipe member connected to the crane wire 50 by separating and disassembling from the additional circular pipe member therebelow is performed when the lower end of the additional circular pipe member connected to the crane wire 50 is present above the water surface. If all additional circular pipe members are removed, as shown in FIG. 13, the crane wire 50 is connected to the main circular pipe member 1. The main circular pipe member 1 is lifted to a required height using the floating crane 500 and loaded on the carrier, thereby completely dismantling the cofferdam 100.

As described above, the cofferdam 100 is dismantled by separating and removing the main circular pipe member and the additional circular pipe members of the cofferdam 100 in order. Thus, the dismantling and removing work may be efficiently performed just with a small-sized or medium-sized floating crane, thereby eliminating the use of a large-scale floating crane. In addition, the work for separating the main circular pipe member and the additional circular pipe member and the work for separating the additional circular pipe members are performed above the water surface. Thus, the cofferdam 100 may be disassembled and dismantled very easily and efficiently through the above separating work.

What is claimed is:

1. A cofferdam construction method, which includes a process of constructing a cofferdam by using a main circular pipe member and an additional circular pipe member and a process of dismantling the cofferdam by disassembling and removing the circular pipe members in order after the use of the cofferdam, wherein the process of constructing a cofferdam includes:

submerging the main circular pipe member made of a steel pipe body such that a lower end of the main circular pipe member is placed on a seabed and an upper end of the main circular pipe member is located above a water surface; and stacking a transported additional circular pipe member vertically on the main circular pipe member and assembling the upper and lower circular pipe members to each other in a watertight form so as to be capable of being disassembled, wherein while the additional circular pipe member is being stacked on and assembled to the main circular pipe member or after the additional circular pipe member is entirely stacked on and completely assembled to the main circular pipe member, a cover for blocking a traverse section of the circular pipe members is installed to the main circular pipe member or the additional circular pipe member, a suction hose is connected to the cover to suck water in an inner hollow below the cover into a negative pressure state to form a suction pressure so that the main circular pipe member is penetrated into the seabed by the suction pressure, and the cover is separated and removed, wherein pile coupling members are integrally provided to outer surfaces of the main circular pipe member and the additional circular pipe member so that a guide pin pile is coupled therethrough, wherein after the main circular pipe member is placed on the seabed, the guide pin pile is inserted into the pile coupling member of the main circular pipe member so that a lower end thereof is vertically installed to be penetrated into the seabed, wherein in the step of stacking the additional circular pipe member vertically on the main circular pipe member, the guide pin pile is inserted into the pile coupling member of the additional circular pipe member so that the additional circular pipe member is stacked while being guided by the guide pin pile to move downward, wherein the process of dismantling the cofferdam includes:

installing an extendable jack device to a newly constructed structure installed in a dry working space secured by the cofferdam, and installing a lifting wire to be connected between the extendable jack device and the main circular pipe member of the cofferdam;

extending the extendable jack device to pull the lifting wire to move the entire cofferdam upward so that the joined portion between the additional circular pipe member and the main circular pipe member is located above the water surface;

separating and removing the additional circular pipe member from the main circular pipe member; and lifting and removing the main circular pipe member.

2. The cofferdam construction method according to claim 1, wherein in the process of constructing a cofferdam, a plurality of additional circular pipe members are stacked in order and assembled to each other in a watertight form so as to be capable of being disassembled, and wherein in the process of dismantling the cofferdam, when the additional circular pipe members are disassembled and removed, an additional circular pipe member located at an uppermost side is disassembled and removed by separating the joined portion above the water surface, then the lifting wire is pulled to further move the cofferdam upward so that a joined portion between the additional circular pipe member at the uppermost side and an additional circular pipe member therebelow is located above the water surface, and then, in a state where the cofferdam temporarily stops moving upward, the upper and lower additional circular pipe members are separated to remove the upper additional circular pipe member, which is repeatedly performed.

3. The cofferdam construction method according to claim 1, wherein in the process of dismantling the cofferdam, before the extendable jack device and the lifting wire are installed to the newly constructed structure, the cover is assembled again to the cofferdam, and water is injected into the inner space below the cover to increase a pressure, so that a lower end of the cofferdam is drawn from the seabed.

* * * * *